US011913654B1

(12) United States Patent
Stamatakis

(10) Patent No.: US 11,913,654 B1
(45) Date of Patent: Feb. 27, 2024

(54) VENTILATION CONTROL SYSTEMS BASED ON AIR EXCHANGE RATE AND VENTILATION PERFORMANCE INDICATOR

(71) Applicant: Senseware, Inc., Vienna, VA (US)

(72) Inventor: Julien G. Stamatakis, Centreville, VA (US)

(73) Assignee: Senseware, Inc., Vienna, VA (US)

( * ) Notice: Subject to any disclaimer, the term of this patent is extended or adjusted under 35 U.S.C. 154(b) by 0 days.

(21) Appl. No.: 16/993,980

(22) Filed: Aug. 14, 2020

(51) Int. Cl.

| | |
|---|---|
| ***F24F 11/30*** | (2018.01) |
| ***F24F 11/00*** | (2018.01) |
| ***F24F 11/52*** | (2018.01) |
| ***F24F 11/58*** | (2018.01) |
| *F24F 120/10* | (2018.01) |
| *F24F 110/66* | (2018.01) |
| *F24F 110/70* | (2018.01) |
| *F24F 110/30* | (2018.01) |

(52) U.S. Cl.
CPC ..... *F24F 11/0001* (2013.01); *F24F 11/52* (2018.01); *F24F 11/58* (2018.01); *F24F 2110/30* (2018.01); *F24F 2110/66* (2018.01); *F24F 2110/70* (2018.01); *F24F 2120/10* (2018.01)

(58) Field of Classification Search
None
See application file for complete search history.

(56) References Cited

U.S. PATENT DOCUMENTS

| | | | |
|---|---|---|---|
| 7,379,981 | B2 | 5/2008 | Elliott et al. |
| 8,103,389 | B2 | 1/2012 | Golden et al. |
| 9,534,929 | B1 | 1/2017 | Stamatakis et al. |
| 9,534,930 | B1 | 1/2017 | Stamatakis |
| 9,538,578 | B1 | 1/2017 | Stamatakis et al. |
| 9,551,594 | B1 | 1/2017 | Stamatakis |
| 9,554,236 | B1 | 1/2017 | Stamatakis |
| 9,714,843 | B1 | 7/2017 | Stamatakis et al. |
| 9,714,844 | B1 | 7/2017 | Stamatakis et al. |
| 9,756,511 | B1 | 9/2017 | Stamatakis et al. |
| 9,762,979 | B1 | 9/2017 | Stamatakis et al. |
| 9,763,118 | B1 | 9/2017 | Stamatakis et al. |
| 9,800,646 | B1 | 10/2017 | Stamatakis et al. |
| 9,813,489 | B1 | 11/2017 | Stamatakis et al. |
| 9,876,653 | B1 | 1/2018 | Stamatakis |
| 9,888,336 | B1 | 2/2018 | Stamatakis |
| 9,942,693 | B2 | 4/2018 | Stamatakis |
| 9,986,411 | B1 | 5/2018 | Stamatakis |
| 10,142,196 | B1 | 11/2018 | Stamatakis et al. |
| 10,143,038 | B1 | 11/2018 | Stamatakis |

(Continued)

OTHER PUBLICATIONS

Parajuli et al., Indoor Air Quality and ventialation assessment of rural mountainous households of Nepal, International Journal of Sustainable Built Environment (2016) 5, 301-311.*

(Continued)

*Primary Examiner* — Bernard G Lindsay

(57) ABSTRACT

A system, method and apparatus for sensor-based air quality metrics for ventilation performance and infection risk. Virus pathogens can be transmitted through the air, as they attach to airborne droplets or particles (bio-aerosols). A ventilation performance and infection risk can be determined using dynamic air exchange rates based on measured changes in air contaminant levels.

19 Claims, 8 Drawing Sheets

(56) References Cited

U.S. PATENT DOCUMENTS

| | | | | |
|---|---|---|---|---|
| 10,149,141 | B1 | 12/2018 | Stamatakis et al. | |
| 10,171,891 | B1 | 1/2019 | Stamatakis | |
| 10,171,972 | B2 | 1/2019 | Stamatakis et al. | |
| 10,178,638 | B1 | 1/2019 | Stamatakis et al. | |
| 10,237,631 | B2 | 3/2019 | Stamatakis et al. | |
| 10,263,841 | B1 | 4/2019 | Stamatakis et al. | |
| 10,313,149 | B2 | 6/2019 | Stamatakis | |
| 10,313,197 | B1 | 6/2019 | Stamatakis | |
| 10,334,417 | B2 | 6/2019 | Stamatakis et al. | |
| 10,536,838 | B2 | 1/2020 | Stamatakis | |
| 10,542,331 | B2 | 1/2020 | Stamatakis | |
| 10,652,767 | B1 | 5/2020 | Stamatakis | |
| 10,687,231 | B1 | 6/2020 | Stamatakis | |
| 10,798,554 | B2 | 10/2020 | Stamatakis et al. | |
| 10,805,697 | B2 | 10/2020 | Stamatakis et al. | |
| 10,833,893 | B2 | 11/2020 | Stamatakis et al. | |
| 10,932,319 | B2 | 2/2021 | Stamatakis | |
| 10,951,961 | B2 | 3/2021 | Stamatakis et al. | |
| 10,992,493 | B2 | 4/2021 | Stamatakis | |
| 10,993,097 | B1 | 4/2021 | Stamatakis et al. | |
| 11,089,388 | B2 | 8/2021 | Stamatakis et al. | |
| 11,089,390 | B2 | 8/2021 | Stamatakis | |
| 11,184,257 | B2 | 11/2021 | Stamatakis et al. | |
| 11,197,146 | B2 | 12/2021 | Stamatakis et al. | |
| 11,259,099 | B2 | 2/2022 | Stamatakis et al. | |
| 2007/0211681 | A1 | 9/2007 | Sun et al. | |
| 2012/0199003 | A1* | 8/2012 | Melikov | G16H 50/80 454/192 |
| 2013/0278427 | A1* | 10/2013 | Setton | G08B 21/12 340/584 |
| 2015/0316945 | A1 | 11/2015 | Soya | |
| 2015/0330817 | A1* | 11/2015 | Law | G16Z 99/00 702/19 |
| 2016/0112518 | A1 | 4/2016 | Haleem et al. | |
| 2018/0163987 | A1* | 6/2018 | Rackes | F24F 11/0001 |
| 2020/0227159 | A1* | 7/2020 | Boisvert | H04L 67/125 |
| 2020/0335226 | A1* | 10/2020 | Hara | G16B 45/00 |
| 2021/0003310 | A1* | 1/2021 | Shnaiderman | F24F 11/30 |

OTHER PUBLICATIONS

Buonanno et al., Estimation of airborne viral emission: Quanta emission rate of SARS-CoV-2 for infection risk assessment, Environment International 141 (2020) 105794, published May 11, 2020.*
Roulet et al., Simple and Cheap Air Change Rate Measurement Using C02 Concentration Decays, International Journal of Ventilation, Jun. 2002.*
Dai et al., 'Association of the infection probability of COVID-19 with ventilation rates in confined spaces', Build Simul (2020) 13: 1321-1327, published Aug. 4, 2020.*
Hyttinen et al., 'Airborne Infection Isolation Rooms—A Review of Experimental Studies', Indoor Built Environ 2011;20;6:584-594, published 2011.*
You et al. 'Measurement of air exchange rates in different indoor environments using continuous CO2 sensors' Journal of Environmental Sciences 2012, 24(4) 657-664, published 2012.*
Khamphanchai et al., Conceptual Architecture of Building Energy Management Open Source Software (BEMOSS), 5th IEEE PES Intelligent Smart Grid Technologies (ISGT) European Conference, Oct. 12-15, 2014.
Dolphin Core Description, EnOcean, Jul. 21, 2014.
Remote Management 2.0, EnOcean, Mar. 6, 2013.
EnOcean—The World of Energy Harvesting Wireless Technology, Feb. 2015.
Wireless Sensor Solutions for Home & Building Automation—The Successful Standard Uses Energy Harvesting, EnOcean, Aug. 10, 2007.
Metasys® System Product Bulletin, Code No. LIT-1201526, Release 7.0, Dec. 5, 2014.
Metasys® System Extended Architecture Wireless Network, Application Note, Oct. 24, 2006.
Metasys® System Field Equipment Controllers and Related Products, Product Bulletin, Code No. LIT-12011042, Software Release 5.0, Jun. 21, 2010.
ZFR1800 Series Wireless Field Bus System, Technical Bulletin, Code No. LIT-12011295, Software Release 10.1, Dec. 5, 2014.
Wireless Metasys® System Product Bulletin, Code No. LIT-12011244, Software Release 5.0, Jan. 4, 2010.
Environmental Index™—Balancing Efficiency with Comfort, Automated Logic Corporation, 2013.
Equipment Portal, Automated Logic Corporation, 2013.
EnergyReports™ Web Application—A Tool for Sustainable Building Operations, Automated Logic Corporation, 2013.
WebCTRL®—Powerful and Intuitive Front End for Building Control, Mar. 26, 2015.
iSelect Adds New Portfolio Company: Bractlet, 2015.
Know—Bractlet, Mar. 7, 2016 (printed).
Analyze—Bractlet, Mar. 7, 2016 (printed).
Ensure—Bractlet, Mar. 7, 2016 (printed).
Announcing Samsara: Internet connected sensors, May 18, 2015.
Samsara—Internet Connected Sensors, Mar. 7, 2016 (printed).
Samsara—Features, Mar. 7, 2016 (printed).
Samsara—Models, Mar. 7, 2016 (printed).
Samsara—API, Mar. 7, 2016 (printed).
Press Release, Helium Makes Sense of the Internet of Things, Oct. 27, 2015.
Press Release, Helium Introduces Another Smart Sensor for Environmental Monitoring, Apr. 25, 2016.
Press Release, Helium Announces Helium Pulse Monitoring and Alerting Application, Apr. 25, 2016.
EE Times, IoT Startup Revises 802.15.4 Nets, Oct. 27, 2015.
Helium Pulsetm™ for Monitoring and Alerting, 2016.
Helium Green™ Environmental Smart Sensor, 2016.
Helium Blue™ Temperature & Door Smart Sensor, 2016.
Cloud Logger, 38 Zeros, 2015.
Smart Processing Starts at the Edge of the Network, B+B Smartworx, 2014.
Wireless Sensors and Output Devices, ConnectSense, 2015.
It's Time You Experienced Eclypse, Distech Controls, 2014.
Compact Sensor, Enlighted, 2015.
Energy Manager, Enlighted, 2015.
Gateway, Enlighted, 2015.
Enlighted Smart Sensor, 2015.
Manning, Lauren, "Wireless Infrastructure Provider Filament Closes $5m Series A, Shows Promise for Agtech Application," Aug. 21, 2015.
Intellastar, 2015.
Your Internet of Things, Monnit, 2014.
Monnit Industrial Wireless AC Current Meter, 2015.
3rd Generation Nest Learning Thermostat, 2015.
AcquiSuite+ Data Acquisition Server, Obvius, LLC, Installation and Operation Manual, Model A8814, Jan. 11, 2014.
Application Note: ModHopper Makes Submetering Easy, Obvius, LLC, Mar. 29, 2012.
ModHopper—Wireless Modbus/Pulse Transceiver, Obvius, LLC, Installation and Operation, Model R9120 (Rev C), Dec. 11, 2012.
Atmel Corporation, 8-bit AVR Microcontroller with Low Power 2.4GHz Transceiver for ZigBee and IEEE 802.15.4, 2014.
Application Note, Atmel AT06482: Real Color ZLL LED Light Bulb with ATmega256RFR2—Software User's Guide, 2013.
Application Note, AT06412: Real Color ZLL LED Light Bulb with ATmega256RFR2—Hardware User Guide, 2014.
Exploring New Lighting Opportunities with ZigBee Light Link Webinar, May 16, 2012.
Point Six Wireless Wi-Fi Sensor Product Guide, 2015.
Eagle, Rainforest Automation, 2015.
Product Comparison Guide, SmartStruxture Lite solution and wireless devices for SmartStruxture solution, Schneider Electric, Mar. 12, 2015.
SmartStruxure Lite Solution, SEC Series, Smart Terminal Controller (SEC-TE), Schneider Electric, Aug. 1, 2013.
SmartStruxure Lite Solution, Schneider Electric, May 1, 2015.
SmartStruxture Lite Solution, Our open system approach to standards and protocols, Schneider Electric, Jul. 2, 2014.

(56) References Cited

OTHER PUBLICATIONS

Senseware, Mar. 25, 2014.
Product Data Sheet, SWS-DPC Wireless Pulse Counters, SpinWave Systems, Inc., 2007.
Product Data Sheet, SWC-TSTAT-3 Wireless Thermostat Controller, SpinWave Systems, Inc., 2012.
A3 Wireless Sensor Network, SpinWave Systems, Inc., 2007.
Veris Industries, 2015.
U.S. Appl. No. 62/025,640, entitled "Separation of Current Sensor and Voltage Sensor for True Power Measurement," filed Jul. 17, 2014.

* cited by examiner

VENTILATION CONTROL SYSTEMS BASED ON AIR EXCHANGE RATE AND VENTILATION PERFORMANCE INDICATOR

BACKGROUND

Field

The present disclosure relates generally to sensor applications, including a system, method and apparatus for sensor-based air quality metrics for ventilation performance and infection risk.

INTRODUCTION

Sensors can be used to monitor physical or environmental conditions. Wireless sensors can be used to collect data from distributed sensors; collected sensor data can be routed from a monitored location to a central location.

BRIEF DESCRIPTION OF THE DRAWINGS

In order to describe the manner in which the above-recited and other advantages and features can be obtained, a more particular description will be rendered by reference to specific embodiments thereof which are illustrated in the appended drawings. Understanding that these drawings depict only typical embodiments and are not therefore to be considered limiting of its scope, the disclosure describes and explains with additional specificity and detail through the use of the accompanying drawings in which.

DETAILED DESCRIPTION

Various embodiments are discussed in detail below. While specific implementations are discussed, it should be understood that this is done for illustration purposes only. A person skilled in the relevant art will recognize that other components and configurations may be used without parting from the spirit and scope of the present disclosure.

Sensors provide a mechanism for discovering and analyzing the state of physical or environmental conditions at a monitored location. Today, insights into indoor air quality conditions have grown in importance, especially as they relate to air contaminant levels and the airborne transmission of virus pathogens.

Wireless sensors provide an efficient mechanism for connecting with and retrieving environmental sensor data from a distributed set of sensors. The growing emphasis on the Internet of Things (IoT) has further reinforced the importance of sensors in capturing needed data in real-time from distributed monitored locations.

In general, a monitored location can represent any area where one or more sensors are deployed. The monitored location may or may not represent a physical area having clearly defined boundaries. As would be appreciated, the extent of the sensor application itself provides a sense of boundary to the monitored location. In one example, the monitored location can represent all or part of a building such as a home, hotel, industrial facility, school, hospital, community building, stadium, airport, convention center, warehouse, office building, store, restaurant, mall, shopping center, data center, multi-dwelling unit, or other defined building structure. In another example, the monitored location can represent all or part of an area of control such as a vehicle, ship or container in any mode of transport, a service area, an entertainment area, an asset collection area, a construction zone, or any monitored area that can be fixed or movable. In yet another example, the monitored location can represent an area proximate to an article, device, person or other item of interest upon which one or more sensors are attached.

Figure 1:
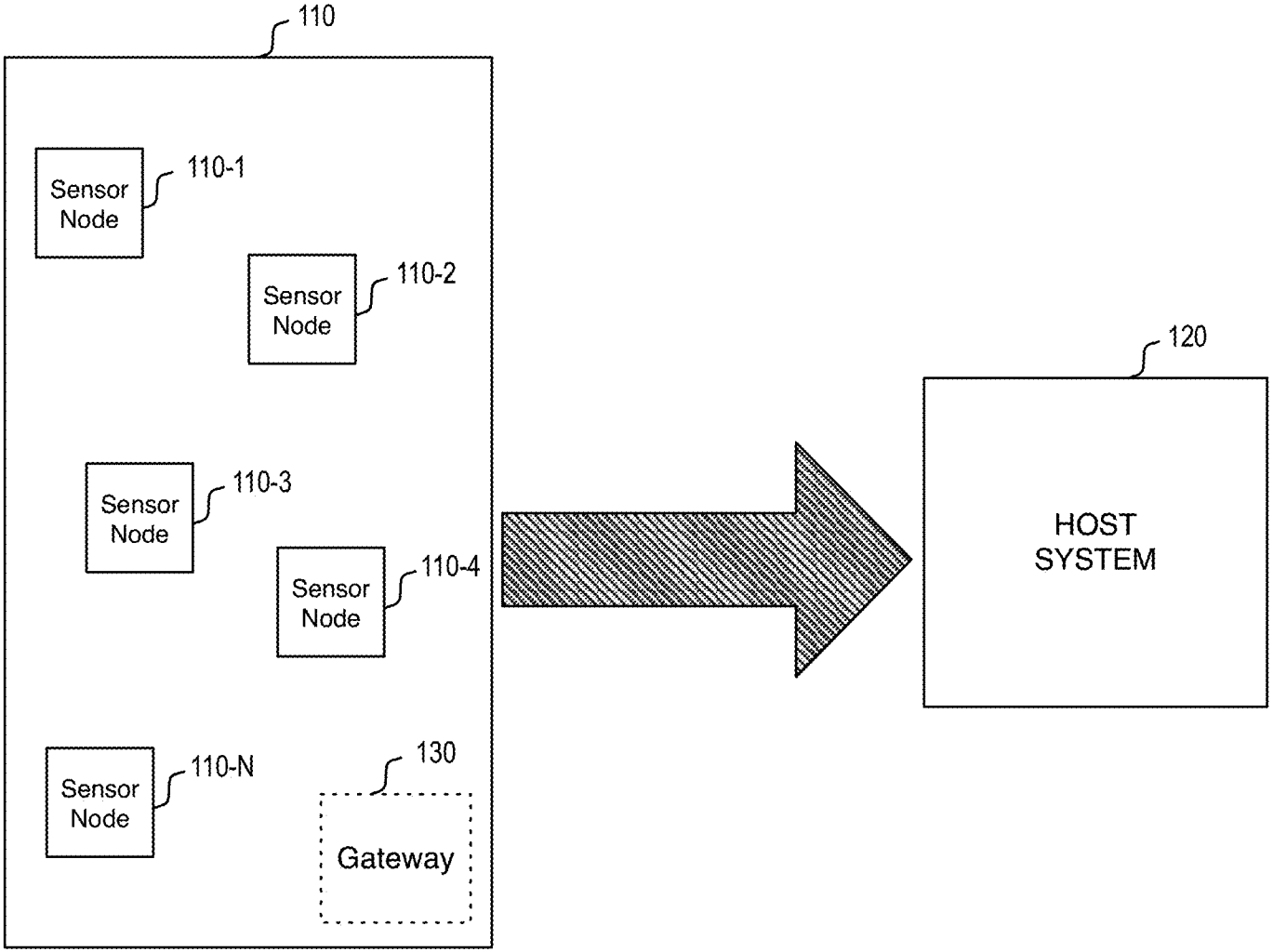
FIG. 1 illustrates an example embodiment of sensor nodes that can collect and distribute sensor information from a monitored location to a host system.

FIG. 1 illustrates an example embodiment of a system that can collect and distribute sensor information from monitored location 110. Disposed within monitored location 110 is one or more sensor nodes 110-1 to 110-N that can individually support one or more sensors and/or actuators. Sensor data from monitored location 110 can be delivered to one or more servers in host system 120. In general, host system 120 can be configured to facilitate the various processes that enable a collection of sensor data from a plurality of monitored locations, processing and storage of sensor data and analytics in a database system, and real-time cloud application services for visualization and optimization.

In one embodiment, sensor nodes 110-*n* can communicate directly with host system 120 via wired or wireless communication. In another embodiment, sensor nodes 110-*n* can communicate with host system 120 via gateway 130. In one embodiment, sensor nodes 110-*n* can be configured to form a network with gateway 130 using various wired or wireless network topologies such as a star network, mesh network, or the like.

Figure 2:
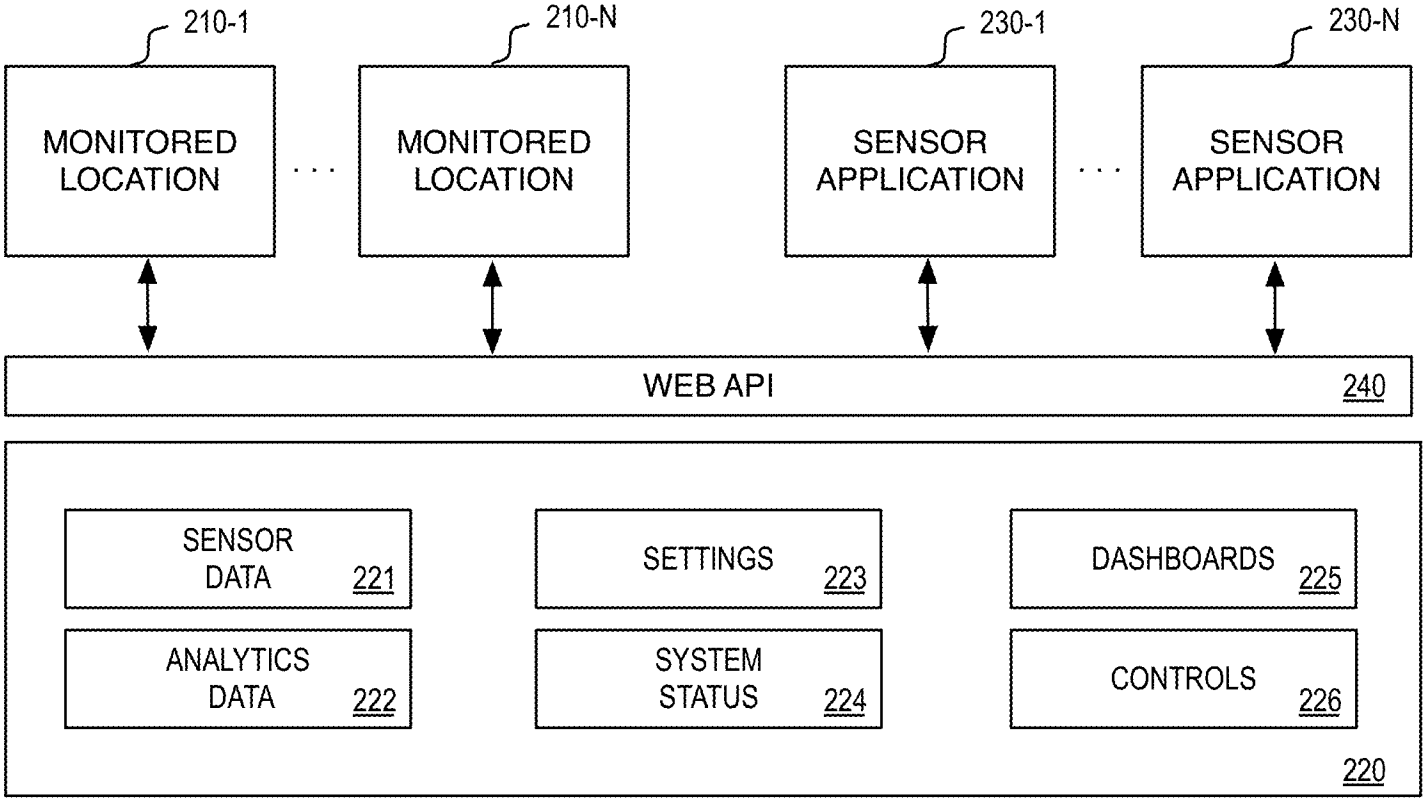
FIG. 2 illustrates an example embodiment of a host system.

FIG. 2 illustrates an example embodiment of a host system that can be embodied in a cloud service framework. As illustrated, host system 220 can collect sensor data 221 from a plurality of monitored locations 210. In one embodiment, analytics data 222 can also be generated by host system 220 based on sensor data 221. In general, analytics data 222 can represent any processed form of sensor data 221.

In one application, a sensor data value can be transformed via a defined conversion relationship (or data transformation) into a single analytics data value. In another application, a plurality of sensor data values can be processed through a defined conversion relationship into a single analytics data value. In yet another scenario, a plurality of sensor data values can be grouped together into a plurality of analytics data values.

In implementing a full-featured sensor service, host system 220 can also enable customization of the collection and processing of sensor data. In one example, a user can specify a conversion function for application to one or more values of sensor data. The conversion function can be stored in the database as settings 223 and applied to one or more values of sensor data 221 to produce one or more values of analytics data 222. Sensor data 221 and/or analytics data 222, along with any derived alerts or notifications, can be displayed on dashboards 225 that are generated by host system 220 for viewing on user devices.

In another example, a user can specify destinations for the distribution of sensor data 221 and/or analytics data 222. For example, separate subsets of sensor data 221 and/or analytics data 222 can be distributed to different destinations. In yet another example, a user can specify configuration settings for application to one or more sensor nodes at a monitored location 210-*n*. The control provided by the specification of these configuration settings enables remote configuration of the sensor nodes at a monitored location 210-*n*.

In one example, the configuration of a sensor node can include an activation or deactivation of a sensor at a monitored location 210-*n*. This activation or deactivation can correspond to particular hours, days, weeks, months, or other periods of time. In another example, the configuration of a wireless sensor node can include a change in the operation of a sensor at a monitored location 210-*n*. In various scenarios, the change in operation of the sensor can relate to a sensitivity characteristic, an accuracy characteristic, a power characteristic, an energy saving characteristic, an operating mode characteristic, a data type or format characteristic, or any other characteristic that relates to an operation of the sensor or the data produced by the sensor. In another example, the configuration of a sensor node can include a change in the operation of a sensor node, such as a frequency of sensor data collection, a power characteristic, an energy saving characteristic, an operating mode characteristic, a data type or format characteristic, or any other characteristic that relates to an operation of the sensor node.

After customization commands have been forwarded to a monitored location 210-*n*, the monitored location can return system update information via web API 240. This system update information can be recorded in the database as system status 224. A sensor application 230-*n* can then retrieve system status information from host system 220 via web API 240 to confirm that the requested configuration changes have been correctly implemented by the sensor network at the monitored location 210-*n*.

The configuration afforded via web API 240 enables a sensor application 230-*n* to customize the operation of a sensor network from a location remote from the monitored location 210-*n*. Notably, the sensor application 230-*n* can customize the operation of only part of the sensor network at a monitored location 210-*n*. A plurality of sensor applications 230-*n* can be configured to leverage different subsets of sensors at one or more monitored locations 210-*n*. From that perspective, host system 220 provides a sensor service to a plurality of sensor applications 230-*n* having varied interests into the detected physical environment at the various monitored locations 210-*n*.

Sensor data 221 and analytics data 222 can also be used as part of a feedback loop to effect controls 226 in producing a corresponding response at a monitored location. In this scenario, sensor data 221 and/or analytics data 222 can represent insights into conditions at a monitored location, whereupon a response to such conditions can be generated in the form of a control action to be fed back to an actuator at a monitored location. In various examples, the control action can be designed to instruct an actuator to initiate a requested action such as a visual alert/display, a change in an actuator state (e.g., off/on), an instruction to equipment (e.g., HVAC) at a monitored location, a change in resource usage or consumption, or to produce any other tangible effect at the monitored location.

In discovering the state of environmental conditions at a monitored location, indoor air quality sensors have become prominent. In one example, sensor nodes can include sensors that can measure temperature, humidity, carbon dioxide, particulate matter, and volatile organic compounds. Additional sensors to measure other gases such as ozone, formaldehyde, carbon monoxide, etc. can also be included. One example of a mechanism for adding a plurality of sensors into a sensor node is described in U.S. Pat. No. 9,551,594, entitled "A Sensor Deployment Mechanism at a Monitored Location."

The discovery of real-time indoor air quality conditions provides significant value when considering the implications of invisible airborne conditions. In the current environment, the fear of what individuals may be breathing has paralyzed many facility owners and operators as they grapple with the immediate threats posed by harmful virus pathogens (e.g., coronavirus). The public has become all too aware of the threat, and assurance will increasingly be required before normal occupancy can resume.

The science has established that virus pathogens can be transmitted through the air, as they attach to airborne droplets or particles (bio-aerosols), usually larger than 0.5 μm. Depending on size, those bio-aerosols can remain in the air from a few minutes to several hours, posing a significant inhalation risk. Bio-aerosols from persons infected by a virus may pose an inhalation threat even at considerable distances and in enclosed spaces, particularly if there is poor ventilation.

With respect to infectious bio-aerosols, the American Society of Heating, Refrigerating and Air-Conditioning Engineers (ASHRAE) has noted that the risk of virus pathogen spread, and therefore the number of people exposed, can be affected by the airflow patterns in a space and by heating, ventilating, and air-conditioning (HVAC) and local exhaust ventilation (LEV) systems. HVAC strategies therefore have the potential to reduce the risks of infectious bio-aerosol dissemination through the monitoring and analysis of ventilation and air filtration performance in a space. As this represents a practical outworking of facility management and optimization, this analysis would have value regardless of the actual infectious bio-aerosol load.

In general, well-operated HVAC systems (ventilation and filtration) represent one of the most effective methods of removing virus pathogens from the air and reducing the risks of bio-aerosol dissemination. The question then arises as to an efficient mechanism for monitoring and analyzing such performance.

This is key to developing confidence that spaces are "safe" in the face of increasing virus infections amongst the populace. Retail, schools, hospitality, government, businesses, and other public buildings can benefit from real-time airborne monitoring, which can be used to mitigate risks posed by viruses and other pathogens.

A structured framework for rapid integration of real-time airborne monitoring can be accomplished using rapid retrofits across an entire footprint of an existing facility. In one embodiment, sensor nodes that include a set of indoor air quality sensors including temperature, humidity, carbon dioxide, particulate matter, and volatile organic compounds can be deployed throughout the various spaces in a monitored location to generate data useful to evaluate ventilation performance throughout the monitored space.

In accordance with the present invention, it is recognized that ventilation performance can be examined through the monitoring of dynamic air exchange rates as reflected by changes in measured air contaminant levels. This analysis goes beyond static measures of air exchange using air flow and room volume because it considers the actual impact of ventilation on contaminant levels based on dynamic changes in contaminant sources in the monitored space.

Consider, for example, a shared workspace served by an HVAC system that has been commissioned based on air flow and work space usage rates as expressed by a theoretical profile. The commissioning of such an HVAC system can result in significant ventilation performance variance based on actual measured performance of the HVAC system in addressing actual contaminant levels produced through actual usage of that shared workspace. These factors would undoubtedly vary over time, which further signals the need for ventilation performance measures based on actual monitored environmental data.

As noted, dynamic air exchange rates can be examined based on measured changes in air contaminant levels. In the example embodiment of a sensor node including carbon dioxide, particulate matter, and volatile organic compounds sensors, each of those sensors are designed to measure levels of different air contaminants. The reduction in contaminant levels can be used to generate a proxy for air exchange rates.

In one embodiment, an air exchange rate indication can be calculated based on the following:

$$AERI_X = \mathrm{MAX}\left(0, \text{Rolling Average}\left(\left[\frac{\Delta t}{3600}\cdot(\ln(X_t - X_0) - \ln(X_{t-1} - X_0))\right], T_X\right)\right)$$

where $X_t$ is the contaminant concentration at time t, $X_{t-1}$ is the contaminant concentration at time t-1, and $X_0$ is the contaminant concentration in clean air, which can be estimated as the minimum value recorded. In one embodiment, the AERI is calculated for each individual contaminant using a time-based series of measurements by an air quality sensor. Thus, in one example, the AERI can be calculated using carbon dioxide measurements, particulate matter measurements (e.g., number of particles of size 2.5 μm or smaller measured), and total volatile organic compounds measurements.

Based on the calculated AERI, a dynamic air exchange rate (AER) can be determined based on the following:

$$AER_X = \text{Rolling Maximum}(AERI_X, T_X)$$

where $T_X$ is the time period over which the rolling maximum is calculated for that particular contaminant. In one embodiment, the time period $T_X$ is determined based on the relative accuracy of the air quality sensor. If the air quality sensor is known to have a higher level of accuracy, then the time period can be shorter, whereas if the air quality sensor is know to have a lower level of accuracy, then the time period can be longer.

In one embodiment, a carbon dioxide sensor having a higher level of accuracy can have a short time period that correlates to every data sample. Thus, if air quality data samples are collected every minute, then the time period $T_X$ could be a one minute time period. Conversely, for a particulate matter sensor or volatile organic compounds sensor having lower levels of accuracy, a longer time period $T_X$ that correlates to every ten data samples (e.g., a ten minute time period) can be used. The dynamic air exchange rate determinations results in a time-based series of air exchange rate values, which can be used to generate an indication of ventilation performance in the monitored location.

It is a feature of the present invention that the ventilation performance indication can be based on a combination of air exchange rate values for multiple contaminants. For example, the ventilation performance indication can combine air exchange rate values produced from measurements by a carbon dioxide sensor, particulate matter sensor, and a volatile organic compounds sensor.

In one embodiment, the ventilation performance indication can be based on the following:

$$\text{Ventilation Performance Indicator} = \text{Rolling Average}\left(\frac{100}{e^{(0.25x+0.25y+0.25z)}}, 5\ \text{min}\right)\%$$

where $$x = e^{\left(\frac{0.0015}{a}*\mathrm{MAX}(0, CO2-TH_{CO2})\right)} - 1 \text{ with } a - e^{(0.25*AER_{CO2})}$$

$$y = e^{\left(\frac{0.0015}{b}*\mathrm{MAX}(0, VOC-TH_{PM})\right)} - 1 \text{ with } b - e^{(0.25*AER_{VOC})}$$

$$z = e^{\left(\frac{0.0015}{c}*\mathrm{MAX}(0, PM-TH_{VOC})\right)} - 1 \text{ with } c - e^{(0.25*AER_{PM})}$$

Figure 3:
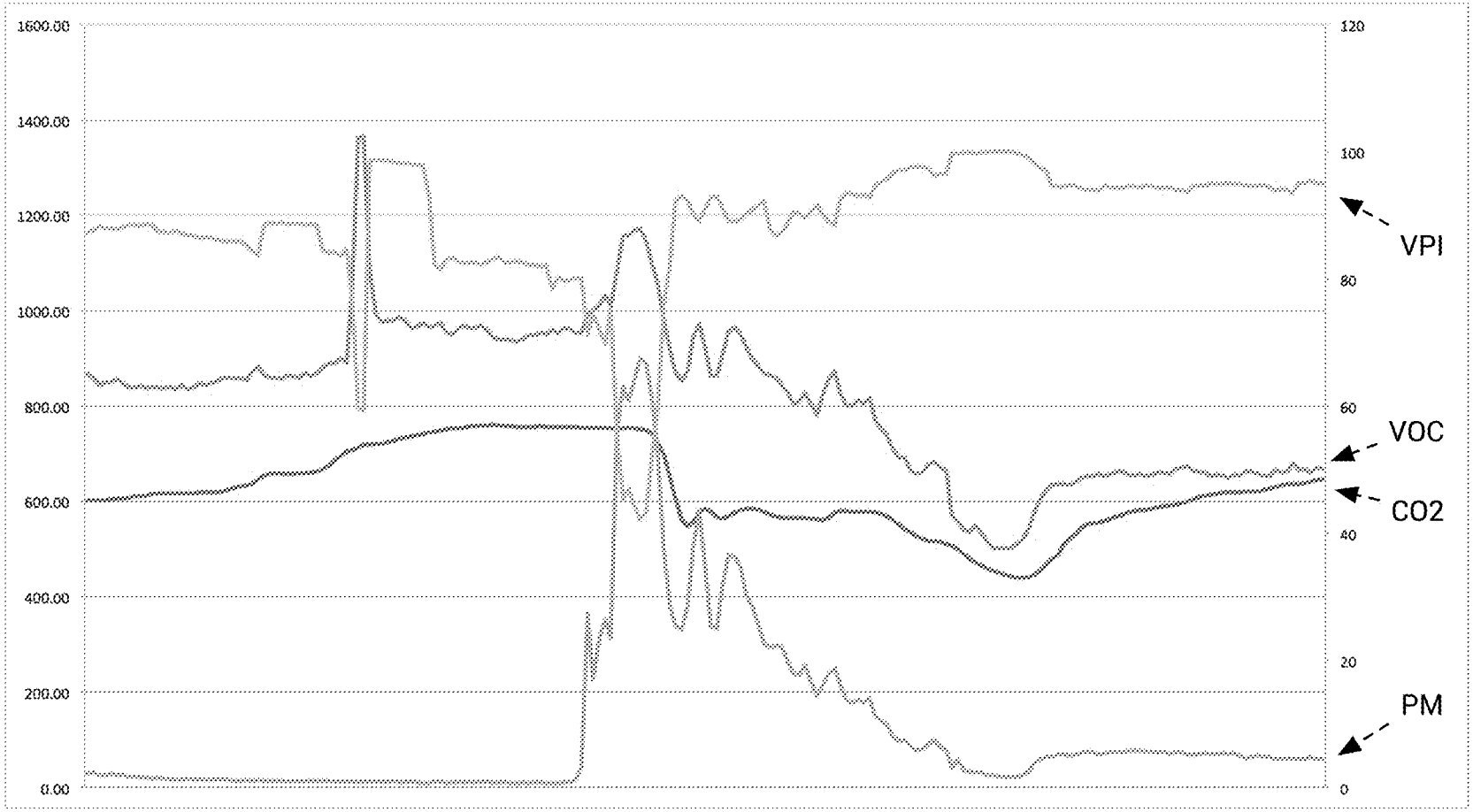
FIG. 3 illustrates an example determination of a ventilation performance indication based on a dynamic air exchange rate indication.

In one embodiment, the threshold TH X can be used to calibrate the functions such that each of the contaminants, if used alone, can attain 50% index at 0.5 AER if they exceed their threshold $TH_X$ by 500. In one example, the values $TH_{CO2}$=700, $TH_{PM}$=90, and $TH_{VOC}$=220 can be used. FIG. 3 illustrates an example determination of a ventilation performance indication based on a combination of dynamic air exchange rate indications for multiple contaminants determined using measurements of carbon dioxide, particulate matter, and volatile organic compounds.

Figure 4:
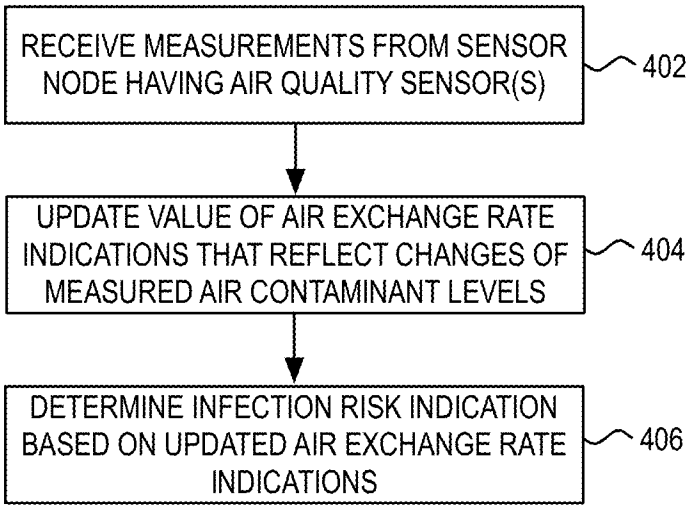
FIG. 4 illustrates a flowchart of an example process of the present disclosure to determine ventilation performance.

FIG. 4 illustrates a flowchart of an example process of the present disclosure to determine ventilation performance. As illustrated, the process begins at step 402 where sensor measurements from a sensor node having one or more air quality sensors are received by a host system. In one embodiment, the air quality sensors can be included in a single sensor node installed at a monitored location at which a ventilation performance indication is sought to be discovered. The measurements received from air quality sensor(s) in the sensor node(s) can be received by the host system as a time-based series of measurements. Each air quality sensor can generate a separate time-based series of measurement data. The frequency at which those measurements can be taken can vary. For example, the measurements can be taken every X minutes, or every Y seconds, as the need for air quality data granularity dictates. In various embodiments, the time-based series of data can be received as individual measurement updates or received in batch form based on the frequency of transmission of sensor measurement data to the host system.

At step 404, the host system uses a received air quality sensor measurement to update a value of an air exchange rate indication. The updated value of the air exchange rate indication is part of a time based series of air exchange rate indication values that reflect changes of measured air contaminant levels. In one embodiment, each air quality sensor measurement is used to generate a new value of an air exchange rate indication such that the time based series of air exchange rate indication values coincides with the time based series of air quality sensor measurements. Such a correspondence is not required. The rate at which the time based series of air exchange rate indication values is updated need not depend on the rate of new air quality sensor measurements received.

Next, at step 406, the host system uses the updated air exchange rate indication value to determine a ventilation performance indicator that indicates a quality of ventilation in reducing air contaminant levels at the monitored location. In one embodiment, a single time based series of air exchange rate indication values derived from measurements from a single air quality sensor is used. In another embodiment, multiple time based series of air exchange rate indication values derived from measurements from multiple air quality sensors is used to determine the ventilation performance indicator. Again, while the ventilation performance indicator is itself a time based series of values, the rate of updating of those values need not correspond to the rate of updating to the air quality sensor measurements or to the updating of air exchange rate indication values.

One of the benefits of deriving a ventilation performance indicator for a monitored location is to assess an effectiveness of the ventilation system in removing actual contaminants from the monitored location. The measured effectiveness is useful as a type of early warning system to quantify whether or not ventilation dead zones exist that are ripe for virus contagion. HVAC optimization depends on this type of real time airborne monitoring data to ensure that the HVAC infrastructure is effective in removing airborne threats efficiently.

It is a feature of the present invention that the air exchange rate determined using measured changes in air contaminant levels can also be used to directly assess risks of infection from virus pathogens transmitted through the air as they attach to bio-aerosols. As noted, bio-aerosols from persons infected by a virus may pose an inhalation threat even at considerable distances and in enclosed spaces, particularly if there is poor ventilation.

The air exchange rate determined using measured changes in air contaminant levels can be used to estimate an infectious virus removal rate, which represents the rate at which bio-particles of an infections virus are removed from the air at a monitored location. The infections virus removal rate is largely dependent on the air exchange rate (i.e., ventilation impact), but can also be impacted by the settling (or deposition) of particles on surfaces, and the rate of viral inactivation based on the half-life of the virus.

In one embodiment, an estimate of the infectious virus removal rate is based solely on the determined air exchange rate. In one example, this determined air exchange rate can represent a maximum value recorded during a given time period. In other embodiments, the estimate of the infectious virus removal rate also considers the rate of settling of particles and the rate of viral inactivation. In one example, the infectious virus removal rate is calculated as the sum of the air exchange rate+the settling rate+the inactivation rate. In one instance, the settling rate is equal to 0.24 $h^{-1}$ when considering the velocity of super-micrometric particles (roughly $1.0\times10^{-4}$ m $s^{-1}$) and the height of the emission source (1.5 m), while the inactivation rate is equal to 0.63 $h^{-1}$ when considering a virus half-life of 1.1 hours.

The infectious virus removal rate can be used to estimate the quanta concentration of the virus, assuming that infected subject(s) are not in the monitored location, as follows:

$$n(t)=n_0\cdot e^{-IVRR\cdot t}$$

where $n_0$ is the is the initial quanta concentration at the time the infected subject(s) left the monitored location.

The quanta concentration while the infected subject(s) are in the monitored location can be calculated as follows:

$$n(t)=\frac{ER_q\cdot t}{IVRR\cdot V}\cdot\left(1-e^{-IVRR\cdot t}\right)$$

where $ER_q$ is the quanta emission rate of the infected subject(s), I is the number of infected subjects in the monitored location, and V is the volume of the monitored location (e.g., conference room size). In one example, which assumes non-strenuous types of activity, the quanta emission rate $ER_q$ can be estimated as 142 $h^{-1}$. As would be appreciated, the estimate used in the model can vary based on the assumption of types of activity by the infected subject(s) in the space.

Figure 5:
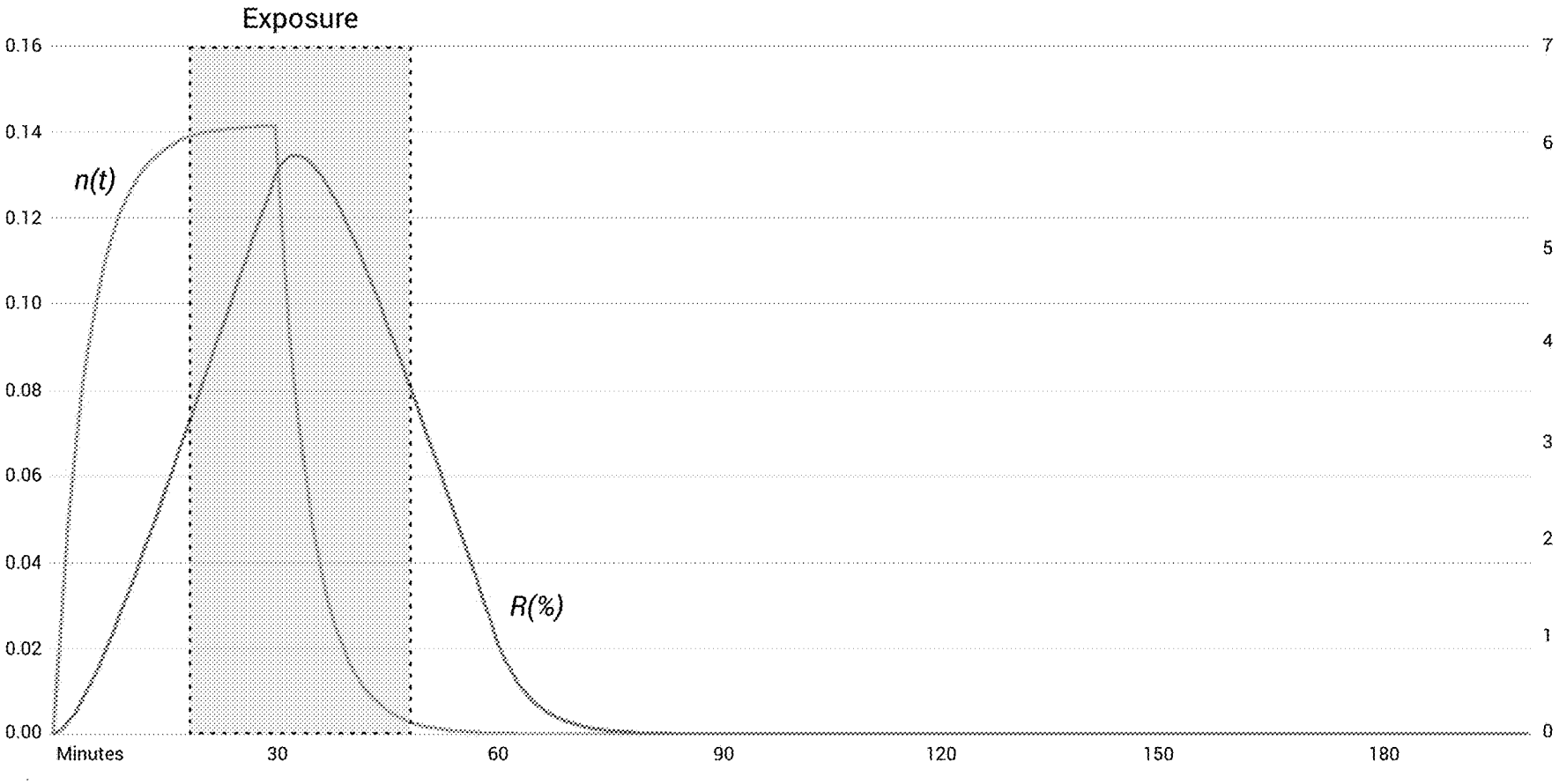
FIG. 5 illustrates an example of the quanta concentration and risk of infection at a monitored location determined based on a dynamic air exchange rate indication.

FIG. 5 illustrates an example of the quanta concentration n(t) at a monitored location, which is determined based on a dynamic air exchange rate indication. In this modeled scenario, it is assumed that an infected subject is at the monitored location for 30 minutes before departing. As illustrated, the impact of the presence of the infected subject at the monitored location is the increase in the quanta concentration n(t). This increase continues for 30 minutes until the infected subject leaves the monitored location, at which point the quanta concentration n(t) begins to dissipate based on the infectious virus removal rate determined through the dynamic air exchange rate indication.

It is a feature of the present invention that the determined air exchange rate indication, which is based on measured changes in air contaminant levels, can be used to model actual quanta concentrations n(t) in every monitored location at which a sensor node having a set of one or more air quality sensors is installed. When considering a network of sensor nodes dispersed throughout a facility, this becomes significant because of the potential for assessing relative risks of infection across the entirety of the facility.

The risks of infection is dependent on the quanta concentrations n(t) that exist during the time that a non-infected person is present at the monitored location. In one embodiment, the risk of infection can be modeled based on the quanta concentrations n(t) as follows:

$$\text{Risk of Infection}=\left(1-e^{-IR\left(\sum_{t_0}^{T} n(t)\Delta t\right)}\right)(\%)$$

where T is the amount of time a non-infected person stays in an infected space (with or without the infected person present) and $t_0$ is the time the non-infected person enters the infected space, Δt represents the increments of time (e.g., one minute increments), and IR is the average inhalation rate for the non-infected person. In one example, the inhalation rate IR is determined to be 0.96 $h^{-1}$, which represents a person that fits a profile of standing and light exercise while being exposed in the infected space.

The risk of infection R(%) is based on the risk of infection calculation over an exposure period of time T. In the illustrated example of quanta concentrations n(t) in FIG. 5, the risk of infection R(%) determination is based on an exposure period of 30 minutes. Thus, the risk of infection R(%) determined for minute 47 is 3.5%, based on the exposure of the non-infected person in the prior 30-minute window from minutes 17-47.

As has been described, the determination of an air exchange rate using measured changes in air contaminant levels enables a quantification of risk at a monitored location. As would be appreciated, this quantification of risk can be tailored to the quanta emission rate ($ER_q$) of the infected subject(s), the assumed number of infected subjects (1) in the monitored location, and the volume (V) of the monitored location. While this quantification of risk would be valuable when considering individual interior spaces, the quantification of risk will also provide significant benefits when considering optimization strategies for space within a facility. The quantification of risk based on actual performance of measured changes in air contaminant levels, which will vary between interior spaces, will enable a facility operator to identify ventilation dead zones that will disproportionately subject occupants to higher risks of infection. Optimization of those facilities will then benefit from an identification of ventilation dead zones, the re-commissioning of the HVAC system tasked with controlling the ventilation of that interior space, and a data-based verification that the HVAC remediation measures have sufficiently addressed the risk of infection issue.

Figure 6:
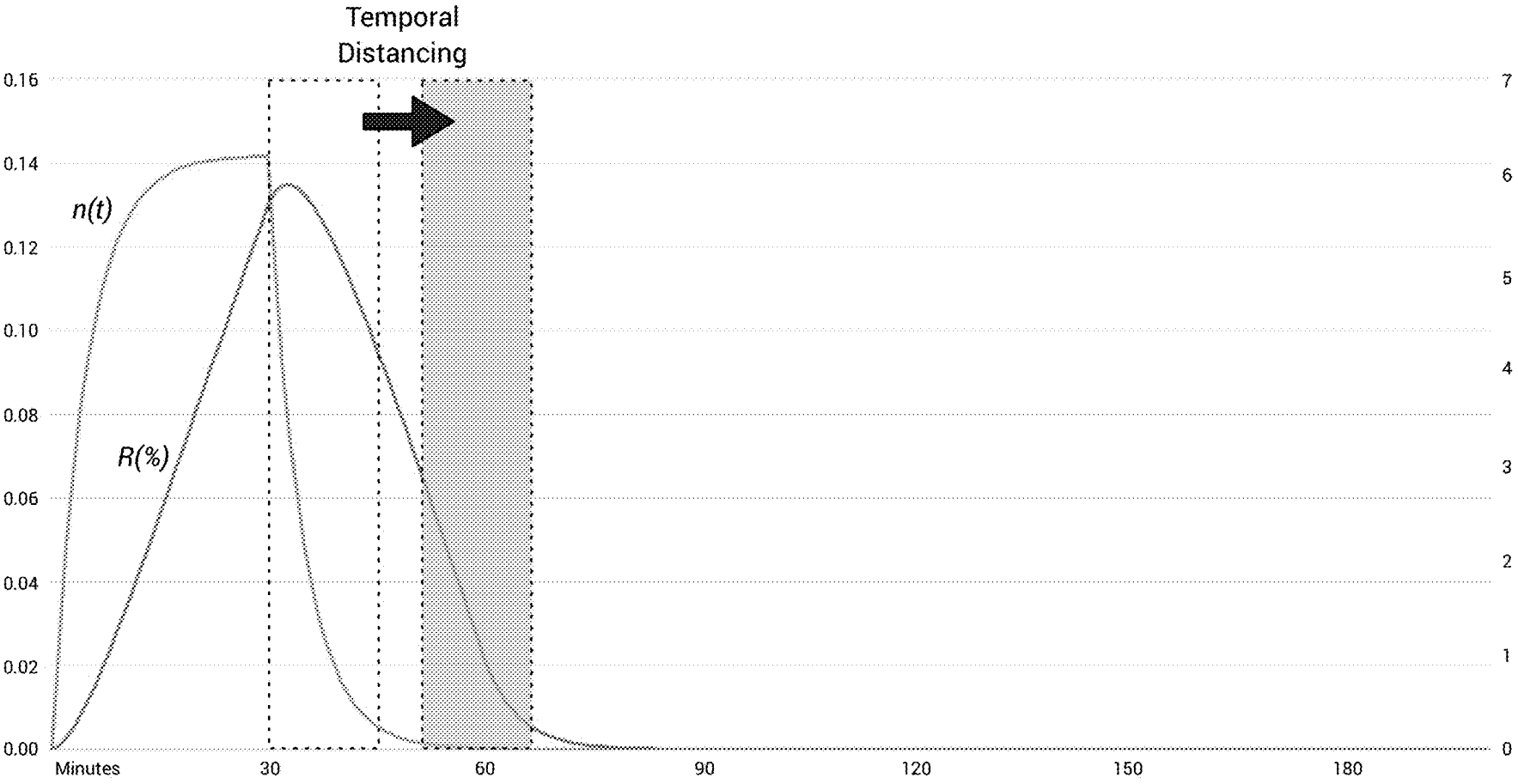
FIG. 6 illustrates an example of temporal distancing.

It is a feature of the present invention that the risk of infection data can also enable optimization of how interior spaces can be used. FIG. 6 illustrates an example of temporal distancing as applied to space utilization when considering the risk of infection data. In this illustrated example, it is again assumed that an infected subject is at the monitored location for 30 minutes before departing. This behavior can coincide, for example, with the usage of a conference room. Once the scheduled meeting completes and the infected subject leaves the conference room, the next meeting can commence.

In this example scenario, assume that a non-infected person enters the conference room and stays for 15 minutes. Based on the quanta concentrations n(t) existing in the conference room, the non-infected person has a risk of infection R(%) determined at minute 45 as approximately 4%.

Instead of this normal conference room usage scenario, assume that a temporal distancing policy is implemented such that a 20-minute buffer is implemented to separate two scheduled conference room meetings. With temporal distancing, the non-infected person would enter the conference room 20 minutes later. The consequence of such a delay is that the infectious virus removal rate will have a greater amount of time of removing bio-particles of an infections virus from the air in the conference room. As illustrated, the risk of infection R(%) of the non-infected person that is present in the room from minutes 50-65 has decreased significantly to approximately 0.2%. The decrease in the risk of infection from 4% to 0.2% is significant and represents a practical and prudent space-utilization approach in addressing infection risks. Leveraging monitoring data that measures changes in air contaminant levels provides real and practical benefits for facility optimization.

Figure 7:
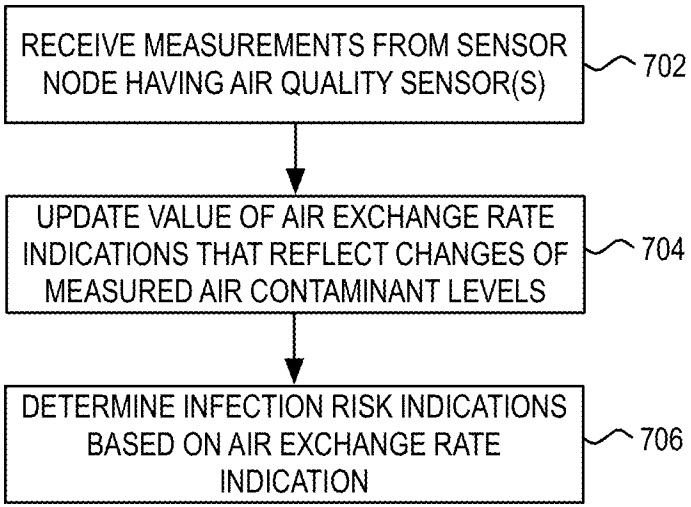
FIG. 7 illustrates a flowchart of an example process of the present disclosure to determine a risk of infection.

FIG. 7 illustrates a flowchart of an example process of the present disclosure to determine a risk of infection. As illustrated, the process begins at step 702 where sensor measurements from a sensor node having one or more air quality sensors are received by a host system. In one embodiment, the air quality sensors can be included in a single sensor node installed at a monitored location at which a risk of infection indication is sought to be discovered. The measurements received from air quality sensor(s) in the sensor node(s) can be received by the host system as a time-based series of measurements. Each air quality sensor can generate a separate time-based series of measurement data. The frequency at which those measurements can be taken can vary. For example, the measurements can be taken every X minutes, or every Y seconds, as the need for air quality data dictates. In various embodiments, the time-based series of data can be received as individual measurement updates or received in batch form based on the frequency of transmission of sensor measurement data to the host system.

At step 704, the host system uses a received air quality sensor measurement to update a value of an air exchange rate indication. The updated value of the air exchange rate indication is part of a time based series of air exchange rate indication values that reflect changes of measured air contaminant levels. In one embodiment, each air quality sensor measurement is used to generate a new value of an air exchange rate indication such that the time based series of air exchange rate indication values coincides with the time based series of air quality sensor measurements. Such a correspondence is not required. The rate at which the time based series of air exchange rate indication values is updated need not depend on the rate of new air quality sensor measurements received. In one embodiment, a maximum value of an air exchange rate indication in a given time period is used as a representative of the air exchange rate indication.

Next, at step 706, the host system uses the air exchange rate indication value to determine an infection risk indicator that indicates a risk of infection from an airborne transmission of virus pathogens at the monitored location. In one embodiment, the infection risk indicator is derived from quanta concentrations n(t) that exist during the time that a non-infected person is present at the monitored location. The quanta concentrations n(t) can be determined using an air exchange rate indication, which is based on measured changes in air contaminant levels.

Figure 8:
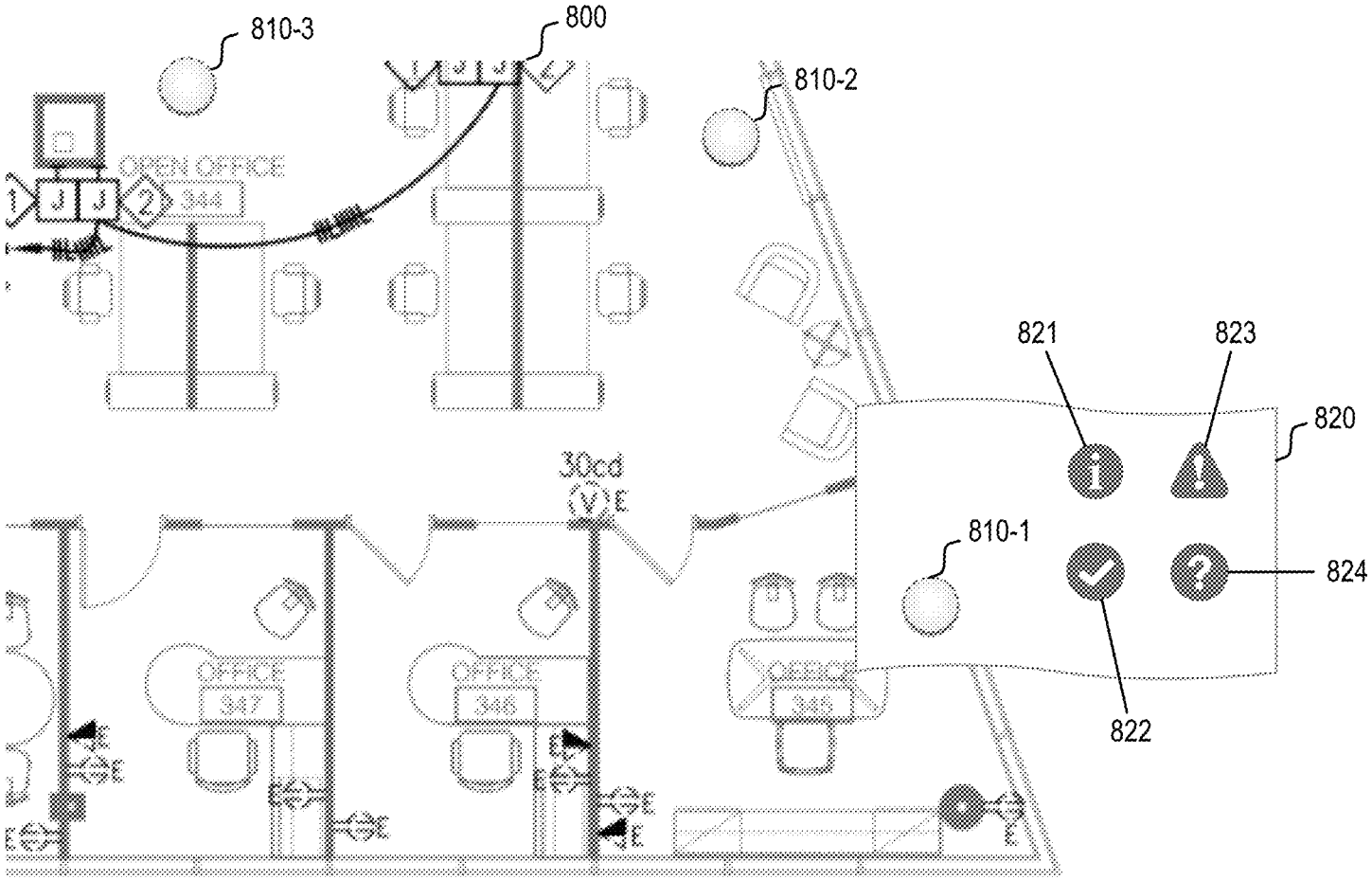
FIG. 8 illustrates an example embodiment of a dashboard interface.

It is a feature of the present invention that the risk of infection data can be displayed as part of a real-time dashboard generated by the host system. FIG. 8 illustrates an example embodiment of a dashboard interface that can be used to display real-time data. As illustrated, the dashboard interface includes a building layout 800, upon which are overlaid icons 810-*n*, which represent individual sensor nodes installed at the monitored location. Each icon 810-*n* enables the user to obtain detailed status information for that sensor node.

As illustrated, selection of icon 810-1 enables the dashboard interface to render user interface 820, which includes icons 821-824 that provide access to further detailed information regarding the sensor node installed at that particular interior space identified by building layout 600. In this example embodiment, icon 821 can enable access to sensor data, icon 822 can enable access to analytics and certification information, icon 823 can enable access to alerts/notifications, and icon 824 can enable access to information about the sensor node associated with icon 810-1. In various embodiments, all or part of the information accessible through user interface 820 can be displayed automatically or upon selection. For example, in one dashboard view all certification data can be displayed for all sensor nodes to enable a high-level overview of the environmental conditions within the space.

In one embodiment, icon 821 enables access to current and historical data from the set of sensors contained in the associated sensor node. For example, where the sensor node includes temperature, humidity, carbon dioxide, particulate matter, and volatile organic compounds sensors, then the historical data (e.g., see detailed monitoring data of FIG. 3) can be displayed and scaled to an appropriate time frame (e.g., hour, day, week, month, year, or other time scale factor) to verify an environmental status at that part of the interior space.

In one embodiment, icon 822 enables access to analytics and certification information that are derived from the sensor data. As described above, analytics information can include ventilation performance index, quanta emission rates, infection risk, temporal distancing, and other optimization analytics derived from measurements from the set of sensors supported by the sensor node. In one example, the set of derived analytics can be used as part of a certification-type process as it provides assurance relative to governing regulations, de facto standards, or internal benchmarks. Icon 822 can enable access to relevant KPIs needed to assess whether that monitored location meets relevant or adopted health and wellness metrics.

In one embodiment, icon 823 enables access to current and historical alerts and notifications for that part of the monitored location. In one scenario, the alerts/notifications can represent a comparison of measured data, analytics or KPIs to threshold values. For example, an alert can be generated when an risk of infection R(%) is determined to be greater than 5%.

In one embodiment, icon 824 enables access to information about the sensor node installed at that part of the monitored location. Such information can include, for example, details about the set of sensors supported by the sensor node, network status information for the sensor node, operational status information, or the like.

Another embodiment of the present disclosure can provide a machine and/or computer readable storage and/or medium, having stored thereon, a machine code and/or a computer program having at least one code section executable by a machine and/or a computer, thereby causing the machine and/or computer to perform the steps as described herein.

Those of skill in the relevant art would appreciate that the various illustrative blocks, modules, elements, components, and methods described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Those of skill in the relevant art can implement the described functionality in varying ways for each particular application. Various components and blocks may be arranged differently (e.g., arranged in a different order, or partitioned in a different way) all without departing from the scope of the subject technology.

These and other aspects of the present disclosure will become apparent to those skilled in the relevant art by a review of the preceding detailed disclosure. Although a number of salient features of the present disclosure have been described above, the principles in the present disclosure are capable of other embodiments and of being practiced and carried out in various ways that would be apparent to one of skill in the relevant art after reading the present disclosure, therefore the above disclosure should not be considered to be exclusive of these other embodiments. Also, it is to be understood that the phraseology and terminology employed herein are for the purposes of description and should not be regarded as limiting.

What is claimed is:

1. A system, comprising:

an air quality monitoring device installed in a monitored area of a building, the air quality monitoring device having a set of one or more sensors that includes an air quality sensor that measures an air contaminant level, the air quality monitoring device installed at a monitored location;

a database configured to store an air exchange rate function and a ventilation performance indicator function;

one or more servers configured to receive a time based series of air quality sensor measurements generated in the air quality monitoring device based on measurements by the air quality sensor of the air contaminant level, wherein for each air quality sensor measurement value received as part of the time based series of air quality sensor measurements, the one or more servers generate an updated air exchange rate value using the air exchange rate function retrieved from the database to produce a time based series of air exchange rate indication, wherein for each updated air exchange rate value generated as part of the time based series of air exchange rate indication, the one or more servers generate an updated ventilation performance indicator value using the ventilation performance indication function retrieved from the database to produce a time based series of ventilation performance indication that assesses the performance of Heating, Ventilation and Air Conditioning (HVAC) equipment in reducing the air contaminant level, the one or more servers further configured to generate a control action based on analysis of the time based series of ventilation performance indication; and an actuator configured to control an operation of the HVAC equipment to automatically adjust an amount of air ventilation produced by the HVAC equipment in the monitored area in the building, the actuator configured to receive control information based on the control action generated by the one or more servers and to increase the air ventilation produced by the HVAC equipment to reduce the air contaminant level in the monitored area in the building.

2. The system of claim 1, wherein the air quality sensor is a carbon dioxide sensor.

3. The system of claim 1, wherein the air quality monitoring device includes a carbon dioxide sensor, a volatile organic compounds sensor, and a particulate matter sensor.

4. The system of claim 1, wherein the one or more servers are configured to generate the time based series of ventilation performance indication based on a first time based series of air exchange rate indication generated using carbon dioxide sensor values, a second time based series of air exchange rate indication generated using volatile organic compounds sensor values, and a third time based series of air exchange rate indication generated using particulate matter sensor values.

5. The system of claim 1, wherein the air exchange rate function includes a time period determined based on an accuracy of the air quality sensor.

6. The system of claim 1, wherein the one or more servers receive the time based series of air quality sensor measurements via a wide area network connection.

7. The system of claim 1, wherein the one or more servers are configured to generate a dashboard that displays the time based series of air quality sensor measurements, the time based series of air exchange rate indication, and the time based series of ventilation performance indication.

8. A system, comprising:

an air quality monitoring device installed in a monitored area of a building, the air quality monitoring device having a set of one or more sensors that includes an air quality sensor that measures an air contaminant level, the air quality monitoring device installed at a monitored location;

a database configured to store an air exchange rate function and an infection risk indicator function;

one or more servers configured to receive a time based series of air quality sensor measurements generated in the air quality monitoring device based on measurements by the air quality sensor of the air contaminant level, wherein for each air quality sensor measurement value received as part of the time based series of air quality sensor measurements, the one or more servers generate an updated air exchange rate value using the air exchange rate function retrieved from the database to produce a time based series of air exchange rate indication, wherein for each updated air exchange rate value generated as part of the time based series of air exchange rate indication, the one or more servers generate an updated infection risk indicator value using the infection risk indicator function retrieved from the database to produce a time based series of infection risk indication that assesses the performance of Heating, Ventilation and Air Conditioning (HVAC) equipment in reducing the air contaminant level, the one or more servers further configured to generate a control action based on analysis of the time based series of infection risk indication; and an actuator configured to control an operation of the HVAC equipment to adjust an amount of air ventilation produced by the HVAC equipment in the monitored area in the building, the actuator configured to receive control information based on the control action generated by the one or more servers and to increase the air ventilation produced by the HVAC equipment.

9. The system of claim 8, wherein the air quality sensor is a carbon dioxide sensor.

10. The system of claim 8, wherein the air quality monitoring device includes a carbon dioxide sensor, a volatile organic compounds sensor, and a particulate matter sensor.

11. The system of claim 8, wherein the one or more servers receive the time based series of air quality sensor measurements via a wide area network connection.

12. The system of claim 8, wherein the one or more servers are configured to generate a dashboard that displays the time based series of air quality sensor measurements, the time based series of air exchange rate indication, and the time based series of infection risk indication.

13. The system of claim 8, wherein the infection risk indicator function includes a volume of a room represented by the monitored area.

14. The system of claim 8, wherein the infection risk indicator function includes an amount of time a person stays in the monitored area.

15. The system of claim 8, wherein the one or more servers is further configured to transmit a temporal distancing indicator that represents an amount of time that the monitored area should remain unoccupied before occupancy resumes.

16. A non-transitory computer-readable medium having a ventilation performance tool stored thereon for use by one or more server devices, the ventilation performance tool including:

a first section that when executed, causes the ventilation performance tool to receive a time based series of air quality sensor measurements generated in an air quality monitoring device based on measurements by an air quality sensor in the air quality monitoring device;

a second section that when executed, causes the ventilation performance tool to generate, for each air quality sensor measurement value received as part of the time based series of air quality sensor measurements, an updated air exchange rate value using an air exchange rate function retrieved from a database to produce a time based series of air exchange rate indication;

a third section that when executed, causes the ventilation performance tool to generate, for each updated air exchange rate value generated as part of the time based series of air exchange rate indication, an updated ventilation performance indicator value using a ventilation performance indication function retrieved from the database to produce a time based series of ventilation performance indication, and a fourth section that when executed, causes the ventilation performance tool to generate a control action based on analysis of the time based series of ventilation performance indication, the control action usable by an actuator configured to control an operation of Heating, Ventilation and Air Conditioning (HVAC) equipment in reducing the air contaminant level, wherein the actuator is configured to receive control information based on the control action and to increase the air ventilation produced by the HVAC equipment.

17. The non-transitory computer-readable medium of claim 16, further comprising a fifth section that when executed, causes the ventilation performance tool to generate a dashboard that displays the time based series of air quality sensor measurements, the time based series of air exchange rate indication, and the time based series of ventilation performance indication.

18. The non-transitory computer-readable medium of claim 16, wherein the air quality sensor is a carbon dioxide sensor.

19. The non-transitory computer-readable medium of claim 16, wherein the air quality monitoring device includes a carbon dioxide sensor, a volatile organic compounds sensor, and a particulate matter sensor.

* * * * *